United States Patent [19]

Leffer

[11] 4,195,402

[45] Apr. 1, 1980

[54] DESSERT CUTTER

[76] Inventor: Elissa Leffer, 84 Ivy Way, Aberdeen Township, Matawan County, N.J. 07747

[21] Appl. No.: 883,901

[22] Filed: Mar. 6, 1978

[51] Int. Cl.[2] ..... B26D 3/24; B26D 3/18

[52] U.S. Cl. ..... 30/114; 30/117; 83/651.1

[58] Field of Search ..... 30/114, 117, 302, 303; 83/651.1, 307.1, 662, 700

[56] References Cited

U.S. PATENT DOCUMENTS

| | | | |
|---|---|---|---|
| 70,205 | 10/1867 | Hardy | 83/651.1 |
| 512,080 | 1/1894 | Winter | 30/117 |
| 653,991 | 7/1900 | Ferry | 83/651.1 |
| 804,566 | 11/1905 | Stewart | 83/651.1 |
| 872,422 | 12/1907 | Hodell | 83/651.1 |
| 874,094 | 12/1907 | Low | 83/651.1 |
| 874,133 | 12/1907 | Stevens | 83/651.1 |
| 1,042,257 | 10/1912 | Oliver | 30/117 |
| 1,868,401 | 7/1932 | Stuart | 30/117 |
| 2,403,190 | 7/1946 | Parraga | 30/117 |
| 3,142,905 | 8/1964 | Strasbaugh | 83/651.1 |

*Primary Examiner*—Robert L. Spruill
*Assistant Examiner*—J. T. Zatarga

[57] ABSTRACT

A dessert cutter particularly useful for delicate cakes with soft and moist composition. A frame supports a plurality of taut wires in a geometric relationship. The frame provides a grip for pressing the wires through a cake and a guide surface for visual alignment during the cutting application.

3 Claims, 4 Drawing Figures

DESSERT CUTTER

BACKGROUND OF INVENTION

Many cakes and other desserts are made with a delicate texture, but their softness, moistness or crumbyness which appeal to the palate often make them difficult to cut into neat serving portions. Conventional kitchen implements, like knives, make one cut at a time and crush or tear the matrix of the dessert rendering it less attractive and making it difficult to produce uniform portions.

SUMMARY

It is therefore the principal object of this invention to provide a cutting implement which will separate the matrix of the dessert to be served without crushing or tearing it into portions which disfigure the original appetizing appearance.

It is another object of this invention to provide simultaneous multiple cuts in a uniform pattern.

In general, the foregoing and other objects will be accomplished by using wires which can cut more cleanly than a blade because they are thinner and offer less surface to stick to the matrix of the dessert. This device arranges wires in a geometric pattern which produces uniform portions. The frame keeps the wires taut and provides a finger grip for manipulating the cutting wires and a vertical edge to sight along for proper positioning of the cutter over the cake to be cut.

BRIEF DESCRIPTION OF THE DRAWINGS

The invention will be described in connection with the accompanying drawings wherein.

DESCRIPTION OF THE INFERRED EMBODIMENT

Figure 1:
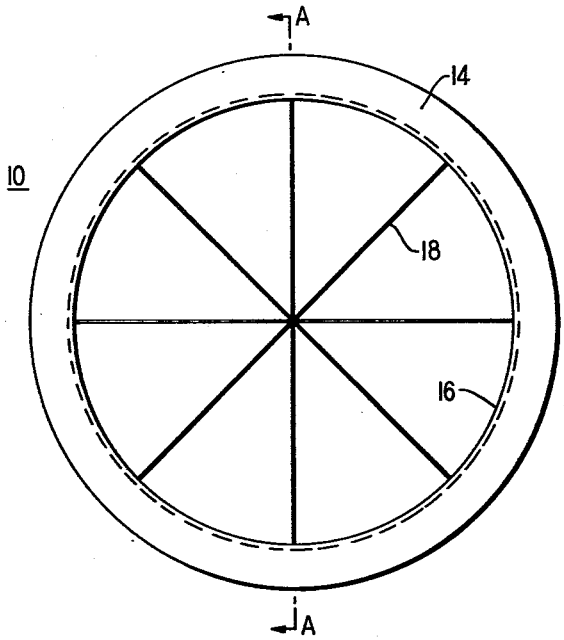
FIG. 1 is a top plan view of the dessert cutter.
Figure 2:
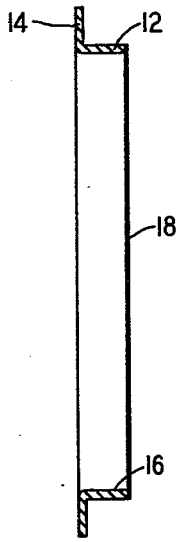
FIG. 2 is an elevational view of the cutter sectioned along A—A in FIG. 1 for purposes of clarity.

Referring to FIGS. 1 and 2, the cake cutter of the present invention includes a peripheral frame 10 comprised of a support portion 12 and a hand grip 14. In the support portion is an inner surface which comprises a guide 16 for positioning the cutter over the cake to be cut. Cutting wires 18 are stretched tautly across the frame and may be fixedly attached to it by threading through holes and knotting or other joinder means well known to the art. In the embodiments shown, however, the preferred construction is depicted. In these preferred or best modes of construction, the wires 18 are fixed across the frame 10 and secured therebelow by soldering or welding or the like. The purpose here is to insure that the wires are the lowermost elements of the novel cutter, and will be the foremost structure upon address of the cutter to the dessert. By such structuring, then, it is assured that the cutting wires will fully traverse the dessert. Some desserts—cakes, for instance, and particularly cheese and fruit cakes—must be fully cut through, or they will leave a thin wafer thereof behind, after all the wedges or servings have been removed. The position and number of the wires will determine the size and shape of the portions, in this embodiment 8 equal wedge shaped portions.

Figure 3:
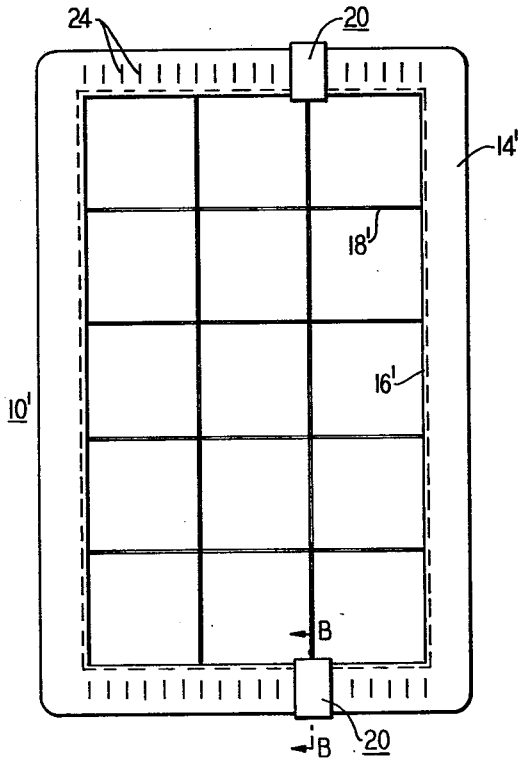
FIG. 3 is a top plan view of a rectangular embodiment that provides slidable wire adjusters.
Figure 4:
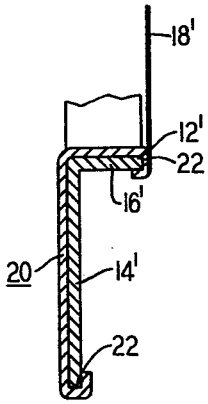
FIG. 4 is an enlarged partial section along B—B of FIG. 3.

In FIG. 3, a cutter for rectangular cakes is illustrated offering an additional feature of movable wires. For the purpose of clarity, the illustration shows only one wire secured at both ends by wire adjusters 20 which are slidably engaged with the frame 10'. As noted in the preceding text, and as clearly depicted, in this embodiment as well the cutting wires 18' are fixed below the frame 10' and underlie the adjusters 20. Again, this best mode of the invention insures that the cutting wires 18' will pass fully through the dessert. It can be seen in FIG. 4 that restraining surface 22 encircles the ends of support 12' and grip 14' thereby preventing disengagement of adjusters from the frame. Indicator lines 24 may be provided on the surface of the grip to meter the size of the portions.

In operation a cake resting on a horizontal surface is cut quickly and neatly into multiple portions by grasping the cutter at opposite ends of grip 14, aligning the cutter over the cake by sighting downward along the guide surface 16, pressing the wires 18 through the cake from top to bottom, and retracting the cutter. In the rectangular embodiment the adjusters 20 or opposite ends of the wire 18' may be slidably moved toward or from the next proximate wire to vary the distance between the wires and hence the size of the cake portion. Alignment of the adjusters with indicator lines 24 will permit the operator to preset the spacing as desired. Movement of one adjuster per wire will produce different geometric shapes.

It is apparent from the foregoing description that the objects of the invention have been carried out. The form of the invention herein shown and described are to be taken as preferred embodiments of the same, but various changes may be made in the shape, size and arrangement of parts without departing from the spirit of the invention or the scope of the attached claims.

I claim:

1. For use with desserts, a cutter, comprising:
   - a peripheral frame having
   - a hand grip portion circumscribing a support portion having a guide surface, and
   - a plurality of stretched cutting wires circumscribed by the guide surface; and further comprising
   - at least one wire adjuster slidably engaged with both said hand grip portion and said support portion of the peripheral frame; wherein
   - said adjuster has one outermost end of one of said cutting wires fixed thereto, to effect a selective displacement of said one end of said one wire upon slidable movement of said adjuster relative to said frame; wherein
   - said hand grip portion comprises an uppermost portion of said frame, and said support portion comprises a lowermost portion of said frame; and
   - said adjuster has a portion thereof which slidably engages and underlies said lowermost portion of said frame; and
   - said one end of said cutting wire underlies said slidably engaged portion of said adjuster, whereby said cutting wire comprises the lowermost element of said cutter and the foremost element addressed to such dessert as is to be cut, to insure that said cutting wire fully traverses said such dessert.

2. The cutter of claim 1 wherein the wire adjuster further comprises surfaces restraining disengagement from the peripheral frame.

3. The cutter of claim 1 wherein the frame further comprises indicator lines whereby the position of said slidable adjuster is monitored.

* * * * *